US011411337B2

(12) United States Patent
Liao

(10) Patent No.: US 11,411,337 B2
(45) Date of Patent: Aug. 9, 2022

(54) VERTICALLY ORIENTED ELECTRICAL CONTACT WITH SYMMETRIC UPPER AND LOWER RESILIENT CONTACTING ARMS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Fang-Jwu Liao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/149,576

(22) Filed: Jan. 14, 2021

(65) Prior Publication Data

US 2021/0218174 A1 Jul. 15, 2021

(30) Foreign Application Priority Data

Jan. 14, 2020 (CN) ..... 202020068708.1

(51) Int. Cl.
*H01R 13/24* (2006.01)
*H01R 12/70* (2011.01)
*H01R 12/71* (2011.01)

(52) U.S. Cl.
CPC ..... *H01R 13/2407* (2013.01); *H01R 12/7082* (2013.01); *H01R 12/712* (2013.01); *H01R 13/2435* (2013.01); *H01R 13/2464* (2013.01)

(58) Field of Classification Search
CPC ..... H01R 12/7082; H01R 12/712–13/2435; H01R 12/2464
See application file for complete search history.

(56) References Cited

U.S. PATENT DOCUMENTS

| | | | | |
|---|---|---|---|---|
| 7,189,080 | B2 | 3/2007 | Hai | |
| 7,862,343 | B1 * | 1/2011 | Lin | H01R 13/2435 439/66 |
| 8,282,431 | B1 * | 10/2012 | Zhang | H01R 13/2435 439/862 |
| 9,257,790 | B2 | 2/2016 | Hai | |
| 10,199,756 | B2 * | 2/2019 | Ju | H01R 13/2457 |
| 2008/0160841 | A1 * | 7/2008 | Polnyi | H01R 13/2478 439/842 |

FOREIGN PATENT DOCUMENTS

| | | |
|---|---|---|
| TW | M363149 | 8/2009 |

* cited by examiner

*Primary Examiner* — Vanessa Girardi
(74) *Attorney, Agent, or Firm* — Ming Chieh Chang; Wei Te Chung

(57) ABSTRACT

An electrical contact is stamped from sheet metal and includes a planar main body, a resilient upper contacting arm extending from an upper end of the main body and a resilient lower contacting arm extending from a lower end of the main body. The upper contacting arm includes an upper oblique section and an upper contacting section at a free end thereof, and the lower contacting arm includes a lower oblique section and a lower contacting section at the free end thereof. The width of the contacting arm is similar to that of the main body while the width of the contacting section is smaller than one half of that of the main body.

6 Claims, 3 Drawing Sheets

VERTICALLY ORIENTED ELECTRICAL CONTACT WITH SYMMETRIC UPPER AND LOWER RESILIENT CONTACTING ARMS

BACKGROUND OF THE INVENTION

1. Field of the Invention

The present invention relates to an electrical contact, and particularly to the electrical contact having two symmetrically arranged upper and lower resilient arms for mating with an electronic package and a printed circuit board.

2. Description of Related Arts

An electrical contact is required to be use with high frequency transmission so that the configuration of the contact should be specifically configured which may be different from the traditional designs.

Therefore, it is desired to provide an electrical contact with the enlarged resilient contacting arm and a narrowed contacting section at the free end.

SUMMARY OF THE INVENTION

An electrical contact is stamped from sheet metal and includes a planar main body, a resilient upper contacting arm extending from an upper end of the main body and a resilient lower contacting arm extending from a lower end of the main body. The upper contacting arm includes an upper oblique section and an upper contacting section at a free end thereof, and the lower contacting arm includes a lower oblique section and a lower contacting section at the free end thereof. The width of the contacting arm is similar to that of the main body while the width of the contacting section is smaller than one half of that of the main body.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
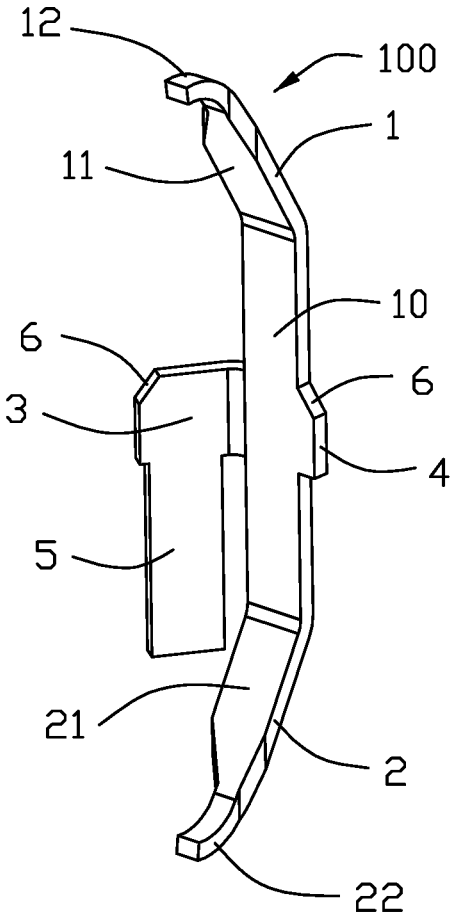
FIG. 1 is a perspective view of an electrical contact according to the invention.
Figure 2:
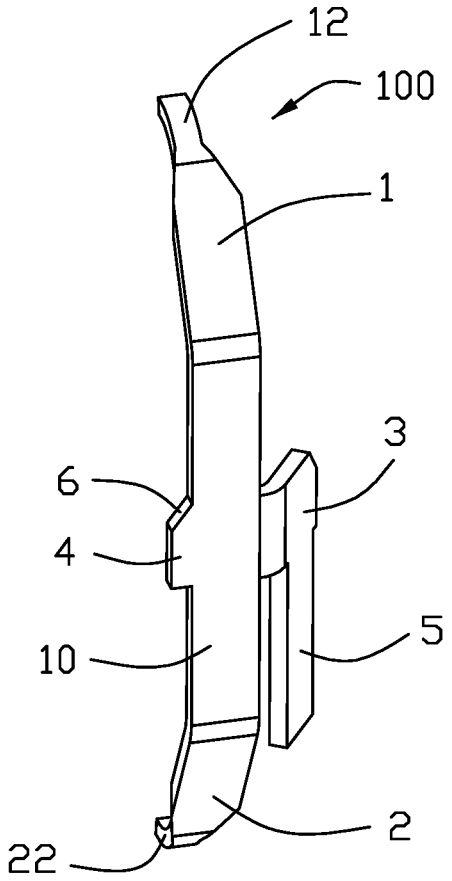
FIG. 2 is another perspective view of the electrical contact of FIG. 1.
Figure 3:
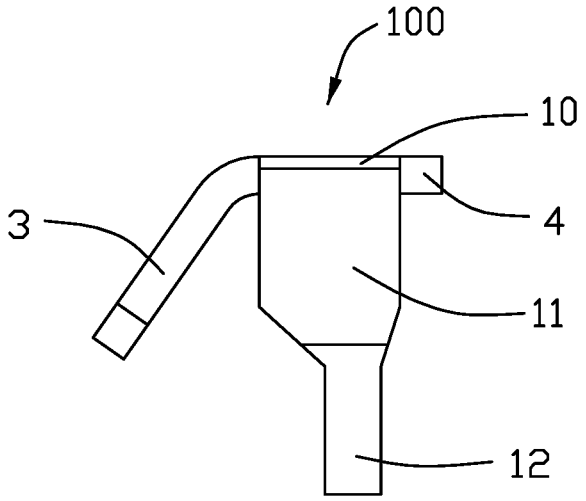
FIG. 3 a top view of the electrical contact of FIG. 1.

Referring to FIGS. 1-3, an electrical contact 100 for connecting an electronic package (not shown) and a printed circuit board (not shown), includes a planar main body 10, a resilient upper contacting arm 1 upwardly extending from an upper end of the main body 10 and a resilient lower contacting arm 2 extending downwardly from a lower end of the main body 10. The upper contacting arm 1 includes an upper oblique section 11 and an upper contacting section 12 at the free end thereof. The lower contacting arm 2 includes a lower oblique section 21 and a lower contacting section 22 at the free end thereof. The upper contacting arm 1 and the lower contacting arm 2 are symmetrically arranged with each other in the vertical direction with regard to the main body 10. The oblique section 11, 21 includes an inner portion (not labeled) linked with the main body 10 with the similar width, and an outer portion linked to the contacting section 12, 22 with a tapered configuration. The width of the contacting section 12, 22 is smaller than that of the oblique section 11, 21. The contact 100 further includes a first retaining section 3 and a second retaining section 4 respectively extending from the opposite lateral sides of the main body 10 and at the same level. An extension 5 extends downwardly from the lower end of the second retaining section 3 for connecting to a contact carrier (not shown) for assembling the contact 100 into the housing of the connector (not shown).

In a top view, the first retaining section 3 is oblique to the main body 10 with an obtuse angle therebetween while the second retaining section 4 is coplanar with the main body 10. A chamfer 6 is formed at each of the first retaining section 3 and the second retaining section 4. Two opposite lateral sides of the oblique section 11, 21 are not symmetrical with regard to the centerline thereof wherein the contacting section 12, 22 is located offset from the centerline of the oblique section 11, 21 toward the lateral side closer to the second retaining section 4 and opposite to the other lateral side which is closer to the first retaining section 3.

The width of the contacting section 12, 22 is around 0.06 mm while the with of the inner portion of the oblique section 11, 21 is around 0.15 mm.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical contact comprising:

a planar main body extending in a vertical plane defining opposite upper and lower ends in a vertical direction, and opposite first and second lateral sides in a transverse direction perpendicular to the vertical direction;

a resilient upper contacting arm extending upwardly from the upper end of the main body and including an upper oblique section and an upper contacting section at a free end thereof;

a resilient lower contacting arm extending downwardly from the lower end of the main body and including a lower oblique section and a lower contacting section at a free end thereof;

a first retaining section extending from the first lateral side of the main body with an obtuse angle therebetween; and a second retaining section extending from the second lateral side in a coplanar manner; wherein a width of the first retaining section is larger than that of the second retaining section, and an extension downwardly extends from the first retaining section in the vertical direction; and the upper contacting section is offset from a centerline of the upper oblique section toward a lateral side of the upper oblique section closer to the second retaining section in the transverse direction than to the first retaining section and the lower contacting section is offset from a centerline of the lower oblique section toward a lateral side of the lower oblique section closer to the second retaining section in the transverse direction than to the first retaining section.

2. The electrical contact as claimed in claim 1, wherein each of the first retaining section and the second retaining section has a chamfer at a respective upper edge thereof.

3. The electrical contact as claimed in claim 1, wherein the upper contacting arm and the lower contacting arm are symmetrically arranged with each other with respect to the main body.

4. The electrical contact as claimed in claim 1, wherein a width of the upper contacting section is smaller than that of the main body, and a width of the lower contacting section is smaller than that of the main body.

5. The electrical contact as claimed in claim 4, wherein the upper oblique section includes an inner portion linked to the main body and having a same width as the main body, and an outer portion having a tapered configuration and linked between the upper contacting section and the inner portion.

6. The electrical contact as claimed in claim 4, wherein the lower oblique section includes an inner portion linked to the main body and having a same width as the main body, and an outer portion having a tapered configuration and linked between the lower contacting section and the inner portion.

* * * * *